United States Patent [19]

Glaser et al.

[11] 4,444,650

[45] Apr. 24, 1984

[54] PROCESS FOR COKING HIGH-BOILING AROMATIC HYDROCARBON MIXTURES TO FORM CARBON MATERIALS HAVING CONSTANT PROPERTIES

[75] Inventors: Herbert Glaser, Gladbeck; Karl-Heinz Koch, Castrop-Rauxel; Rolf Marrett, Castrop-Rauxel; Manfred Meinbreckse, Friedrichsdorf, all of Fed. Rep. of Germany

[73] Assignee: Rutgerswerke Aktiengesellschaft, Frankfurt, Fed. Rep. of Germany

[21] Appl. No.: 299,434

[22] Filed: Sep. 4, 1981

[30] Foreign Application Priority Data

Sep. 20, 1980 [DE] Fed. Rep. of Germany ..... 3035593

[51] Int. Cl.[3] ..... C10G 9/42

[52] U.S. Cl. ..... 208/106; 208/131

[58] Field of Search ..... 208/106, 131

[56] References Cited

U.S. PATENT DOCUMENTS 1,794,542 3/1931 Piron ..... 208/106
2,427,589 9/1947 Chechot ..... 208/106
3,274,097 9/1966 Biehl ..... 208/106
4,066,532 1/1976 Garcia ..... 208/131

*Primary Examiner*—Delbert E. Gantz
*Assistant Examiner*—Glenn A. Caldarola
*Attorney, Agent, or Firm*—Beveridge, DeGrandi & Kline

[57] ABSTRACT

Disclosed is a continuous or discontinuous process for coking high-boiling aromatic hydrocarbons to form high grade carbon products having only a narrow range of variation of physical and chemical properties. High-boiling aromatic hydrocarbon mixtures are coked in thin layers according to a defined temperature/time program, and the functional relationship between layer thickness and optimum coking time, which applies to that program for the particular hydrocarbon mixture used, is determined by means of a simple preliminary experiment. A small quantity of the hydrocarbon mixture used is coked on a microscope hot stage under standardized conditions to determine the minimum coking temperature, the time to the final coking temperature and the dependence of coking time on the layer thickness.

12 Claims, 1 Drawing Figure

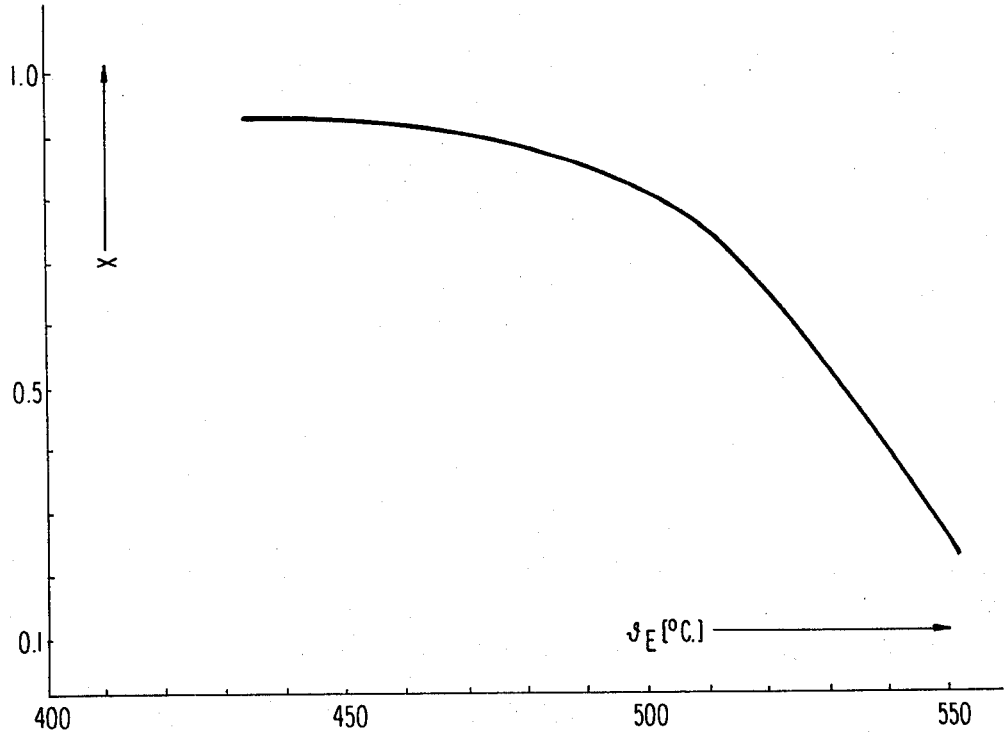
1.0
0.5
0.1
x
ϑE [°C.]
400
450
500
550

PROCESS FOR COKING HIGH-BOILING AROMATIC HYDROCARBON MIXTURES TO FORM CARBON MATERIALS HAVING CONSTANT PROPERTIES

The present invention relates to a process for the coking of high-boiling aromatic hydrocarbon mixtures to form carbon materials having constant properties.

Elektrodes for electric arc furnaces are produced from calcined petroleum cokes with binders by calcining and graphiting; carbon anodes for aluminum electrolysis or chlorine alkali electrolysis are obtained from pitch coke or petroleum coke with the aid of a binder (electrode pitch) by pressing and subsequent calcining. For obtaining constant properties of the carbon electrodes, it is of decisive importance to maintain certain quality characteristics of the cokes and binders. The quality characteristics for these cokes are mainly the real density, the content of volatile components, contents of trace elements, the specific electrical resistance and the coefficient of thermal expansion.

High-aromatic hydrocarbons are particularly suitable for the production of these cokes, because of their molecular structure, which resembles the structure of graphite. The processes, known in technology, for the production of cokes from liquid starting products may be summarized as follows:

1. The delayed coking process (Hydrcarbon Processing, July 1971, pp 85–92);
2. The coking of pitch in vertical-flue coke ovens (Franck/Collin: Steinkohlenteer (Coal Tar), 1968, pp 54–66); and
3. The fluid coking process (Erdölverarbeitung (Petroleum Processing), Volume 10, pp 670–71).

All the processes have attained large-scale industrial importance, but, owing to their differing modes of operation, they yield different cokes with regard to the quality of the coke.

The delayed cooking process is a quasi-continuous coking process, which is predominantly used for the coking of starting products of petroleum origin. Products of coal tar origin have been hitherto coked in only few plants.

The highest quality anisotropic coke commercially obtainable up to the present time is produced in the delayed coker under pressure and at temperatures of about 500° C. Owing to the quasi-continuous type of operation of the coker, the soaking time schedule for the starting material is from 2 to 24 hours. As a result, the coke becomes non-uniform, which considerably reduces its quality. The subsequent calcination can only incompletely compensate this disadvantage.

In the vertical-flue coke oven, pitch coke is produced from coal tar hard pitch with a coking residue according to Brockmann-Muck of greater than 50%. Due to the rapidly attained high coking temperature of about 1100° C., the anisotropic character of the coke is only inadequately observed. Consequently, the specific electrical conductivity is low and the coefficient of thermal expansion high. In this case, again, differing qualities of coke result, which are due to the temperature course in the coke chamber.

The fluid coking process yields a markedly expanded, almost isotropic coke which, owing to its particle size and particle strength, is virtually employed only as a fuel.

The different fields of application make differing requirements regarding the quality of the coke, which can only be achieved, in any case, by optimum adaptation of the prior art processes to the properties of the starting products. It is particularly difficult to produce highly anisotropic or wholly isotropic cokes. Production of medium qualities does not present any difficulties.

Hitherto, anisotropic grades of coke have been produced from special fractions of petroleum origin or from specially pre-treated coal tar pitches by coking within the temperature range around 500° C. under pressure. It is essential, in this connection, to pass through the temperature range for the development of the coke structure of between 370° and 500° C. with the lowest possible temperature gradient. An average soaking time of 12 hours corresponds to the heating-up time in the delayed coker.

It is therefore an object of the present invention to develop a suitable continuous or discontinuous process for coking high-boiling aromatic hydrocarbons to form high grade carbon products having only a narrow range of variation of physical and chemical properties, the coking conditions being adapted to the raw material and the desired properties of the coke to an optimum extent.

According to the invention, this object is attained by coking suitable high-boiling aromatic hydrocarbon mixtures in thin layers according to a defined temperature/-time program, preferably under atmospheric pressure, and determining the functional relationship between layer thickness and optimum coking time, which applies to that program for the particular hydrocarbon mixture used, by means of a simple preliminary experiment.

In this preliminary experiment, a small quantity of the hydrocarbon mixture used is coked on a microscope hot stage under standardized conditions. The product, heated to 350° C., is slowly heated up on the hot stage at 15 K/min., until the first meso-phases are observed in the pitch under the microscope. The temperature indicates the minimum coking temperature $\theta o$. Subsequently, the temperature of the hot stage is increased at an approximately constant heating rate to 550° C. and the time $\tau^*$ taken to the solidification of the meso-phase to green coke is determined.

The graph or diagram in the accompanying drawing shows the dependence of temperature-dependent exponent X as a function of $\vartheta_E$ which is the final coking temperature of the hydrocarbon mixture used.

Experiments with various mixtures of aromatic hydrocarbons at differing layer thicknesses have shown that the dependence of the coking time $\tau$ of the layer thickness $\delta$ may be represented as follows:

$$\tau = a \cdot \delta^X$$

wherein X is a temperature-dependent exponent. Its dependence is shown in the graph in the drawing as a function of $\vartheta_E$. The proportionality factor a corrects for product influences and differing thermodynamic conditions of the operating unit in relation to the hot stage. It ranges within the limits of between 3 and 9 when the coking time $\tau$ is calculated in minutes. It is determined, as a first approximation, from the preliminary experiment and, in case it should be necessary, it can still be slightly corrected during operation according to the representation:

$$a^* = (\tau^*/\delta^{*X}) \sim a$$

wherein a* is the proportionality factor based on the experiment, $\tau^*$ is the coking time measured during the experiment and $\delta^*$ is the thickness of the layer of the starting material in the experiment.

It has been surprisingly found that the meso-phase primary stage, which is required for anisotropic cokes and must have high fluidity for the development of large structures, already appears in layers, a few mm thick, at coking times of the order of minutes. This makes coking possible in thin layers of up to 100 mm, preferably from 5 to 50 mm, also for the production of highly anisotropic cokes in economically acceptable periods of time. Heating rate is variable within wide ranges. It can be very high for thin layers, e.g. 150° C./min., but should be lower for thicker layers, so as to ensure a dense, highly linked coke structure. A heating rate of $$d\vartheta/dt = 500[\text{mm}\cdot\text{K/min}]\cdot 1/\delta[1/\text{mm}]$$

has proved particularly advantageous. While coking at atmospheric pressure is preferred, a pressure of from 0.05 to 10 bar can be used.

Coking can be effected discontinuously, e.g. in a calcining furnace provided with trays, with an adjustable temperature program, or continuously, e.g. in a tunnel furnace, equipped with a steel conveyor belt, the zones of said calcining furnace being regulated to a temperature, constant for each case, according to the calculated belt speed and the heating rate chosen.

High-boiling aromatic hydrocarbon mixtures suitable for use in the present invention include residues from coal refining and petroleum oil processing operations, having an initial boiling point of above 350° C. and an aromatic content of above 70%, such as, for example, residues from coal tar processing, from coal conversion processes and from the processing of residual oils from catalytic and thermal cracking units for petroleum oil fractions. The process can be applied with particular advantage to pitches and pitch-like materials, the initial boiling point being above the coking temperature in question.

The process of the invention is explained in detail in Examples 1 to 6. Example 7 is a comparative example of an anisotropic coke, produced according to a known process in the delayed coker; a higher standard deviation of the volumetric coefficient of thermal expansion is a measure of lack of uniformity of the coke.

In the examples and throughout the specification and claims, all parts and percentages are by weight unless otherwise specified.

EXAMPLE 1

A coal tar pitch having a softening point (E.P.) of 90° C. (K.S.) and 0.3% quinoline-insoluble matter (QI) is pre-heated to 350° C., applied in a 2 mm thick layer to a microscope hot stage which has been pre-heated to 350° C., and the temperature of the hot stage slowly raised at 15 K/min. Visible mesophases are formed under the microscope at $\vartheta_O = 390°$ C. The hot stage regulator is set at 550° C. and, after 9 minutes, the mesophases have solidified to a semi-coke. The final coking temperature $\vartheta_E$ is 500° C. The graph in the drawing shows that at this temperature, exponent X=0.8. The layer thickness $\delta^*$ is known to be 2 mm and the coking time $\tau^*$ has been measured as 9 minutes, the proportionality factor a is given by the equation:

$$a = \tau^*/(\delta^*)^X = 5.17$$

The pitch is coked on trays in 10 mm layers in a gas-heated calcining furnace in a flue gas atmosphere under normal pressure. The coking time $\tau$ is calculated from the preliminary experiment as:

$$\tau = a\cdot\delta^X = 5.17\cdot 10^{0.8} = 32.6 \text{ min.}$$

The calcining furnace, pre-heated to 350° C., is charged with the trays filled with pitch and the temperature is heated up within 3 minutes to 500° C. The temperature is maintained for 29.6 minutes.

A low temperature coke is formed in 45% yield, having 4.5% volatile components. The coke, calcined at 1300° C., has a volumetric coefficient of thermal expansion of $3.7\pm0.2\cdot10^{-6}K^{-1}$ in the temperature range between 20° and 200° C. The total coking time can be reduced to 30 minutes, in which case the volatile content rises to 6%, without the coefficient of thermal expansion being changed. The proportionality factor decreases by 9% to 4.75.

EXAMPLE 2

The coking temperature for a coal tar hard pitch having a softening point of 150° C. (K.S.) and 0.2% quinoline-insoluble matter (QI), is determined as 500° C. and the coking time $\tau^*=8$ minutes. This results in a proportionality factor of a=4.59. The pitch is continuously coked on a steel conveyor belt heated on the underside with gas jet flames to 500° C. in a layer thickness of 5 mm in an inert gas stream under normal pressure. The speed of the steel belt is adjusted so that the pitch coke leaves the heating zone after a calculated coking time of 16.6 minutes. The pitch coke, accruing in 79% yield, has a volatile content of 7.6%. The volumetric coefficient of thermal expansion is determined on the coke calcined at 1300° C. as $3.0\pm0.2\cdot10^{-6}K^{-1}$ in the temperature range of between 20° and 200° C.

EXAMPLE 3

The distillation residue of a residual oil from the pyrolysis of naphtha to ethylene, having a softening point (E.P.) of 120° C. and 0.15% quinoline-insoluble matter (QI), is studied in accordance with Example 1 and coked, as in that case, at a final temperature of 490° C. in a 50 mm thick layer. The proportionality factor, calculated from the preliminary experiment, is a=6.3. This gives a coking time of 162 minutes for the 50 mm layer. The reverberatory furnace is heated up at 10K/min. The coke, obtained in a yield of 68%, has a volatile content of 6% and, in the calcined state, a volumetric coefficient of thermal expansion of $4.0\pm0.2\cdot10^{-6}K^{-1}$.

EXAMPLE 4

An aromatic residue from coal liquefaction having an aromatic content of 89%, a softening point (E.P.) of 125° C. and 0.1% quinoline-insoluble matter (QI), is studied in accordance with Example 1 and coked, as in that case, in a 100 mm thick layer at a final temperature of 480° C. The proportionality factor is 4.0 and thus the coking time for the 100 mm layer is 220 minutes. The reverberatory furnace is heated up at 0.6 K/min. A low temperature coke is obtained in 89% hield, having 6.5% volatile matter and, in the calcined state, a coefficient of thermal expansion of $3.2\pm0.2\cdot10^{-6}K^{-1}$ between 20° and 200° C.

EXAMPLE 5

A coal tar hard pitch having a softening point (E.P.) of 150° C. (K.S.) and 9.7% quinoline-insoluble matter (QI) is studied in accordance with Example 1. The final coking temperature is 500° C. and the proportionality factor a=7.7. The pitch is continuously coked on a steel belt in a 20 mm thick layer. The belt is heated over a length of 10 m. The temperature of the first section having a length of 1 m is heated only to 430° C., the remaining part to 500° C. The calculated coking time of 84.5 minutes results in a belt speed of 12 cm/min. The coke has a volatile content of 6% at a yield of 84%. The calcined coke has a volumetric coefficient of thermal expansion of $13.5\pm0.3\cdot10^{-6}K^{-1}$, as a result of the high content of quinoline-insoluble matter in the pitch used.

EXAMPLE 6

A coal tar hard pitch produced by distillation and having a softening point (E.P.) of 210° C. (K.S.) and less than 0.1% quinoline-insoluble matter (QI) is studied in accordance with Example 1. The final coking temperature is 450° C., and the proportionality factor a=9.0. The pitch is coked in 100 minutes in a 15 mm thick layer. The heating rate of the reverberatory furnace is 20 K/min. A low temperature coke having 7% of volatile matter is formed in 92% yield. The volumetric coefficient of thermal expansion of the calcined coke was determined between 20° and 200° C. as $2.7\pm0.2\cdot10^{-6}K^{-1}$.

COMPARATIVE EXAMPLE 7

A coal tar pitch having a softening point (E.P.) of 75° C. (K.S.) and 0.1% quinoline-insoluble matter (QI) is coked in the delayed coker at 498° C. for an average soaking time of 12 hours and at a pressure of 5 bar. A low temperature coke having 12% of volatile matter is formed in 76% yield. After calcining at 1300° C. this coke has a volumetric coefficient of thermal expansion of $3.6\pm0.8\cdot10^{-6}K^{-1}$.

What is claimed is:

1. A process for the coking of a high-boiling aromatic hydrocarbon mixture to form carbon materials having constant properties which comprises heating and coking said hydrocarbon mixture in layers up to 100 mm thickness according to a defined temperature/time program whereby the functional relationship between layer thickness and optimum coking time which applies to that program is determined for the particular hydrocarbon mixture used by means of a preliminary experiment which comprises heating and coking a small quantity of said hydrocarbon mixture under standardized conditions, determining the minimum coking temperature thereof by observing the first meso-phases therein, determining the coking time and final coking temperature taken to the solidification of the meso-phase to green coke and calculating said temperature/time program from the values thus determined wherein the coking time $\delta$ in minutes is a function of the layer thickness $\delta$ in mm determined by the formula:

$$\tau=a\cdot\delta^X$$

wherein the proportionality factor a is ascertained from the coking time in said preliminary experiment and ranges between 3 and 9 and the temperature-dependent exponent X results from the final coking temperature $\vartheta_E$ ascertained in the preliminary experiment, and from the graph in the drawing in which an exponent X of 0.9 has been empirically ascertained for a final coking temperature $\vartheta_E$ of 450° C., an X of 0.8 for $\vartheta_E$=500° C. and an X of 0.5 for $\vartheta_E$=530° C.

2. The process according to claim 1, wherein the high-boiling aromatic hydrocarbon mixture being coked is a residue from coal refining, a residue from petroleum oil processing operations or mixture thereof having a boiling point above 350° C. and an aromatic content about 70%.

3. The process according to claim 2 wherein the hydrocarbon mixture is a residue from coal tar processing, from a coal conversion process or from the processing of residual oils from thermal or catalytic cracking units for petroleum oil fractions.

4. The process according to claim 2 or 3 wherein the initial boiling point of the high-boiling aromatic hydrocarbon mixtures is higher than the coking temperature thereof.

5. The process according to claim 1 wherein the layer thickness of the hydrocarbon mixture which is heated and coked is from 5 to 50 mm.

6. The process according to claim 1 wherein said preliminary experiment is conducted on a microscope hot stage.

7. The process according to claim 1 wherein during the coking operation a heating rate $d\vartheta/dt$ in K.min. is chosen so that the following relationship to the layer thickness $\delta$ in mm is approximately maintained:

$$d\vartheta/dt=500/\delta.$$

8. The process according to claim 1 wherein coking is discontinuously effected according to said temperature/time program.

9. The process according to claim 8 wherein the coking is conducted in a calcining furnace provided with shelves for trays.

10. The process according to claim 1 wherein the coking is continuously effected.

11. The process according to claim 10 wherein the coking is conducted in a tunnel furnace equipped with a steel conveyor belt and divided into differing temperature zones regulated to a constant temperature in each zone corresponding to the belt speed and heating rate.

12. The process according to claim 1 wherein aromatic hydrocarbon mixtures are coked to form a highly anisotropic coke having a volatile content of from 4 to 8% and, after calcining at 1300° C., a volumetric coefficient of thermal expansion within the range of from 20° to 200° C., of from 2 to $4\cdot10^{-6}K^{-1}$.

* * * * *